US005852917A

United States Patent [19]

Romagnoli

[11] Patent Number: 5,852,917

[45] Date of Patent: Dec. 29, 1998

[54] METHOD OF MANUFACTURING DOUBLE-CHAMBERED INFUSION BAGS BY FOLDING

[75] Inventor: Andrea Romagnoli, San Lazzaro Di Savena, Italy

[73] Assignee: I.M.A. Industria Machine Automatiche S.p.A., Bologna, Italy

[21] Appl. No.: 750,054

[22] PCT Filed: Apr. 2, 1996

[86] PCT No.: PCT/IT96/00066

§ 371 Date: Dec. 4, 1996

§ 102(e) Date: Dec. 4, 1996

[87] PCT Pub. No.: WO96/31399

PCT Pub. Date: Oct. 10, 1996

[30] Foreign Application Priority Data

Apr. 4, 1995 [IT] Italy ..... B095A0147

[51] Int. Cl.[6] ..... B65B 51/10

[52] U.S. Cl. ..... 53/479; 53/134.2; 53/116; 53/120; 493/254; 493/447

[58] Field of Search ..... 53/479, 134.2, 53/120, 116, 117; 493/254, 449, 448, 447

[56] References Cited

U.S. PATENT DOCUMENTS

| | | | |
|---|---|---|---|
| 3,493,226 | 2/1970 | Weir | 443/449 |
| 3,656,271 | 4/1972 | O'Shea et al. | 53/120 |
| 3,977,152 | 8/1976 | Rochla et al. | 53/120 |

FOREIGN PATENT DOCUMENTS

| | | | |
|---|---|---|---|
| 1 001 944 | 1/1957 | Germany . | |
| 2120270 | 4/1974 | Germany | 53/134.2 |
| 1 207 630 | 3/1987 | Italy . | |
| 2 202 210 | 9/1988 | United Kingdom . | |

*Primary Examiner*—John Sipos
*Assistant Examiner*—Gene L. Kim
*Attorney, Agent, or Firm*—Cushman, Darby & Cushman IP Group of Pillsbury, Madison & Sutro LLP

[57] ABSTRACT

A tubular blank of filter paper containing measured and separate quantities of tea, or a similar infusionable substance, is pleated and folded so as to obtain a bag with two envelopes by a method that includes the steps of advancing blanks singly and in succession along a feed direction tangential to an indexing wheel with radial grippers, taking up each blank in a position above three bearing elements ordered along the feed direction, forming a pleat in an intermediate portion of the blank, then pinching the two ends of the blank by use of movable pressure elements interacting with two of the bearing elements so as to prevent the escape of the contents from the envelopes while at the same time drawing the tubular blank toward the wheel to bring the two envelopes together and give the filter bag its final shape.

5 Claims, 2 Drawing Sheets

13
10c
12
16
1
10a
2
14
1
16
10b
6
7
8
11
9
6
15
15
15
4
4
3
20

METHOD OF MANUFACTURING DOUBLE-CHAMBERED INFUSION BAGS BY FOLDING

This application is the national phase of international application PCT/IT96/00066 filed Apr. 2, 1996 which designated the U.S.

1. Technical Field

The present invention relates to a method of pleating and folding a tubular blank of filter paper, elongated in appearance and containing measured and separate quantities of a substance with which to prepare an infusion, in such a way as to obtain a filter bag exhibiting two distinct envelopes. The method in question comprises the steps of:

conveying tubular blanks of filter paper singly and in succession along a feed direction extending substantially tangential to a rotatable wheel equipped with radial grippers providing respective arms by which each filter bag is taken up, compacted and conveyed further;

taking up a tubular blank of filter paper in a position above at least three bearing elements ordered along the feed direction, of which two are stationary, shaped in such a way as to converge toward the wheel and offered to opposite ends of the tubular blank, while the third is capable of movement transversely to the feed direction;

forming a pleat in an intermediate portion of the tubular blank;

folding the tubular blank double in such a way as to draw the respective envelopes together, by inducing a movement that commences in the position at which the tubular blank is taken up above the bearing elements and terminates at a position in which the tubular blank, guided by the stationary bearing elements, comes to rest between the arms of the gripper with the two ends close together.

The method relates in particular to a twin envelope type of filter bag in which the pockets containing the substance terminate in closures created with folds made in the paper mechanically.

Bags of the type now being described are utilized widely in the packaging of substances intended for infusion, in particular tea, herbal powders, etc., for the reason that the division of the measure into two half-measures results in an easier and swifter contact with water and therefore a better preparation of the beverage. The bag is fashioned from a tubular blank of filter paper, cut initially from a continuous strip that has been folded and secured longitudinally to produce the tubular section: a pleat of familiar "W" profile is formed across the middle part of the blank, serving to separate the two pockets or envelopes, whereupon the two envelopes are rotated about the pleat and brought together side by side to establish the final shape of the bag.

2. Background Art

In a first method of the type now being described, implemented using a manufacturing machine of broadly conventional design (see DE 1 001 944), the tubular blanks are directed onto a wheel equipped with grippers, which is rotatable and capable thus of movement intermittently through a succession of work stations. The pleat is formed by interaction with the wheel at one of these stations, whereupon the two envelopes are folded double and brought together by respective arms emerging from the wheel.

Having thus received its essential shape, the filter bag undergoes further operations, chief among which being the formation of a closure effected by folding the ends of the tubular blank in suitable manner.

By reason of the fact that the manufacturing operations mentioned above are brought about on a structure moving at high speed, and intermittently moreover, the contents of the bag are subjected to a certain agitation that can cause the substance in the envelopes to shift and collect in localized areas; the dimensions of the bag thus become enlarged at the points which favor the accumulation of the substance, and it becomes impossible to obtain a package of compact proportions when several bags are assembled for wrapping.

By reason also of the fact that the ends of the tubular blank remain open when the envelopes are folded double, it can happen that the contents drift across the areas where the end folds are to be made subsequently, thus compromising the efficiency of the resulting closures.

A second method of manufacturing this type of filter bag from tubular blanks (see IT 1 207 630) comprises the step of heat-sealing the closures of the envelopes before forming the central pleat and then folding the chambers together.

The pleating and folding steps both occur remotely from the gripper wheel in this instance. More exactly, the blank is folded double through the agency of specifically designed transfer means by which the blanks are forced to pass through stationary converging rests, so that the envelopes are drawn gradually together.

In this method there is obviously no possibility that the contents of the envelopes will penetrate the respective closures, since the respective enclosures are secured before the transfer takes place; nonetheless, the heat-sealed closure represents an even greater drawback due to the risk of the beverage being contaminated by the adhesive utilized.

SUMMARY OF THE INVENTION

Accordingly, the object of the present invention is to overcome the drawbacks outlined above.

The stated object is realized in a pleating and folding method comprises a step, effected between the steps of forming the pleat and folding the tubular blank around the pleat, in which the ends of the blank are pinched by the action of movable pressure elements operating in conjunction with fixed bearing elements. The purpose of such a pinching step is to prevent the contents of the envelopes from shifting toward the ends of the bag during its movement toward the wheel.

To additional advantage, the steps of forming the pleat and folding the tubular blank around the pleat are effected both simultaneously and through the agency of the same active elements. This allows on the one hand of achieving shorter cycle times, and on the other, of utilizing machines able to perform the method with a limited number of working parts: a factor bringing clear benefits of economy in construction and reliability in operation.

BRIEF DESCRIPTION OF THE DRAWINGS

The invention will now be described in detail, by way of example, with the aid of the accompanying drawings, in which.

DETAILED DESCRIPTION

Figure 4:
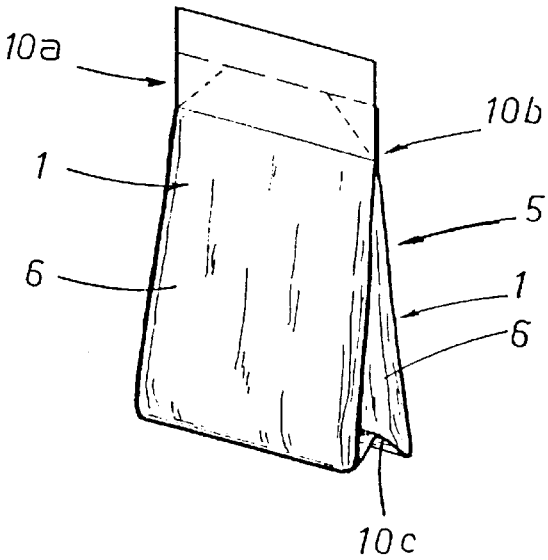
FIG. 4 illustrates a bag containing a substance with which to prepare an infusion, as obtained in the final step of the method disclosed.
Figure 4:
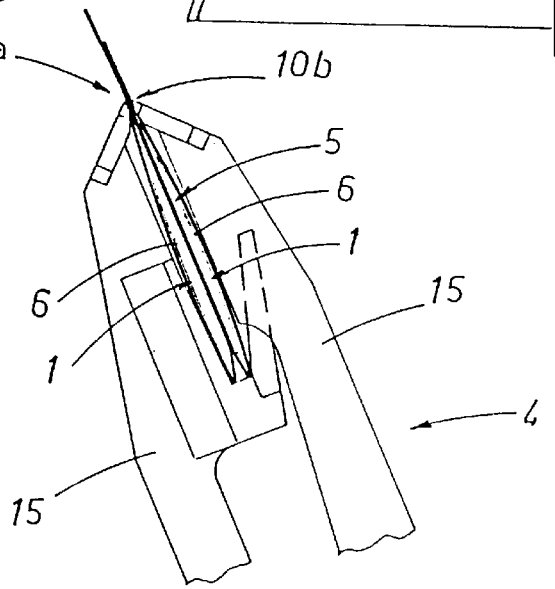

As indicated in the accompanying drawings, the method to which the invention relates is one of pleating and folding a tubular blank 1 of filter paper, elongated in appearance and containing measured and separate quantities of a substance with which to prepare an infusion, to the end of obtaining a filter bag 5 that exhibits two distinct envelopes 6, as shown in FIG. 4.

The method consists essentially in the steps of:

conveying tubular blanks 1 along a feed direction;

taking up a tubular blank 1 in a position above three bearing elements 7, 8 and 9;

fashioning a W-profiled pleat 12 across an intermediate portion 10*c* of the tubular blank 1;

pinching the ends 10*a* and 10*b* of the tubular blank 1;

folding the tubular blank 1 double.

Figure 1:
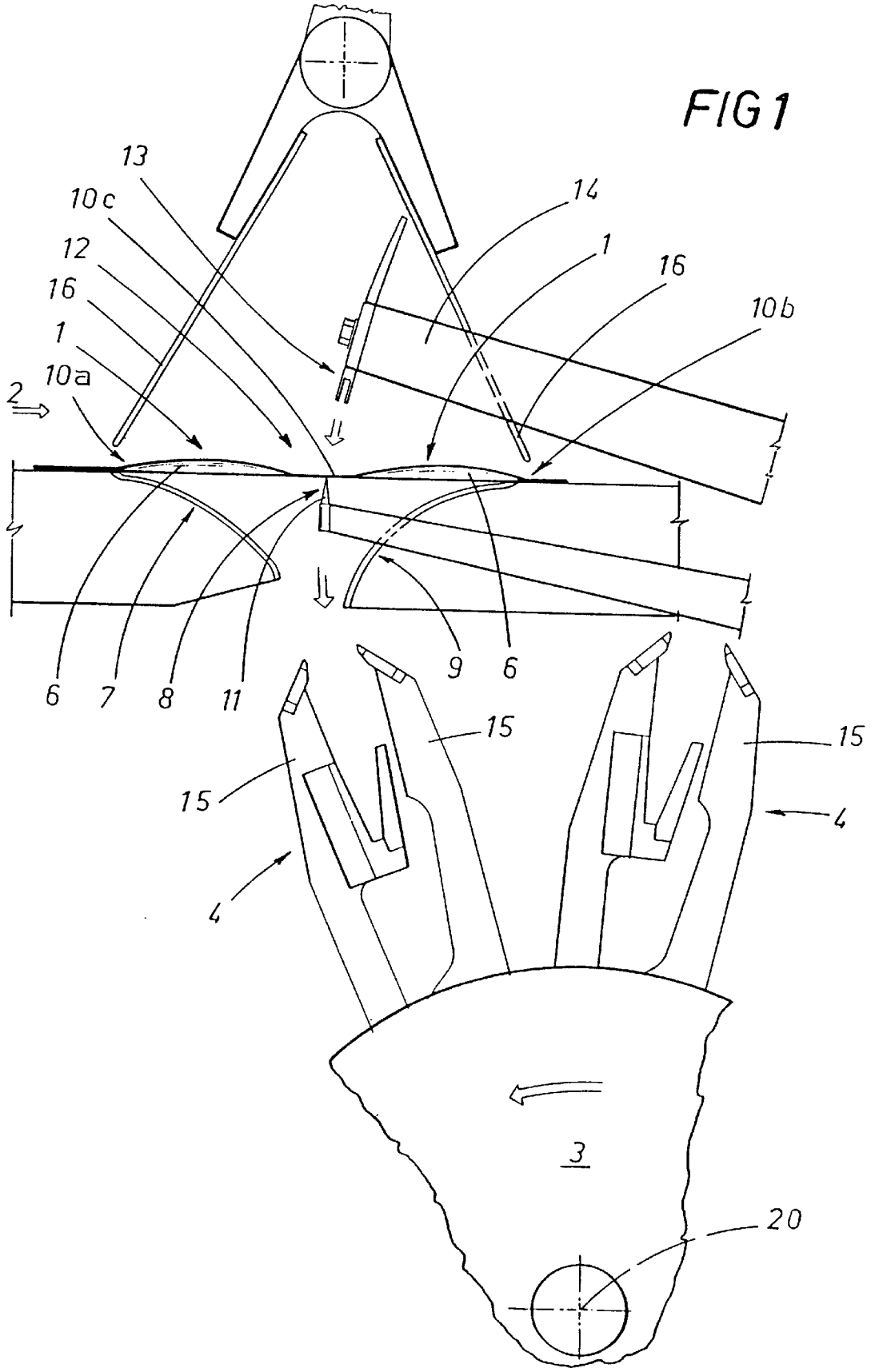
FIGS. 1, 2 and 3 illustrate a succession of steps, viewed schematically in side elevation and with certain details omitted, reflecting a possible implementation of the method disclosed.

In the initial step, the tubular blanks 1 are caused to advance singly and in succession along a feed direction 2 extending substantially tangential to a rotatable wheel 3 equipped with radial grippers 4 affording respective pairs of arms 15, by which the bags 5 are taken up and compacted (see FIG. 1) before being conveyed further, all in the context of a process implemented with packaging equipment of conventional embodiment not illustrated in the drawings.

In the second step, a tubular blank 1 is positioned over the three bearing elements 7, 8 and 9, which are ordered in sequence along the feed direction 2. Two of the elements 7 and 9 are designed to receive the opposite ends 10*a* and 10*b* of the tubular blank 1: these occupy fixed positions and are embodied with surfaces converging toward the wheel 3 beneath. The third element 9 is capable of movement transversely in relation to the feed direction 2 and performs a plurality of functions: as discernible from the drawings, in effect, this same bearing element 8 also assists in forming the pleat 12, and accordingly is provided with a forming die 11 of suitable shape designed to interact with a further die 13 of matching profile carried by the end of a forming element 14 positioned above the tubular blank 1.

The step of pinching the ends 10*a* and 10*b* of the tubular blank is brought about through the agency of movable pressure elements 16, operating in conjunction with the stationary bearing elements 7 and 9, which engage the blank 1 in such a manner as to prevent the contents of the envelopes 6 from moving toward the corresponding ends 10*a* and 10*b*. Observing the drawings, it will be appreciated that such a movement would be favoured by the forces of inertia generated during the initial movement of the bag 5 toward the wheel 3, which is characterized by a certain acceleration.

Figure 2:
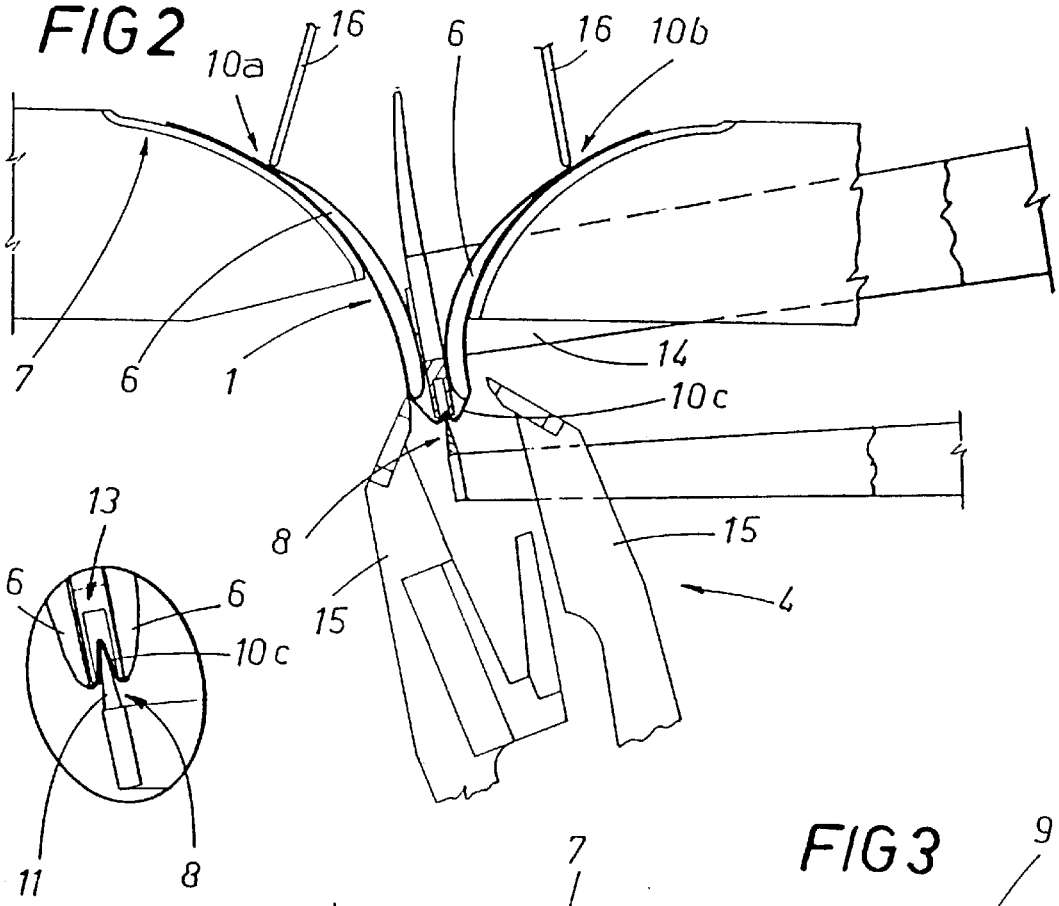
Figure 2A:
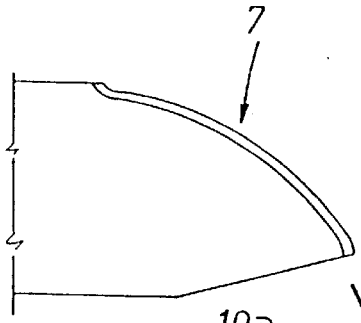
FIG. 2*a* is a larger scale fragmentary schematic side elevational view of a portion of what is shown in FIG. 2.
Figure 3:
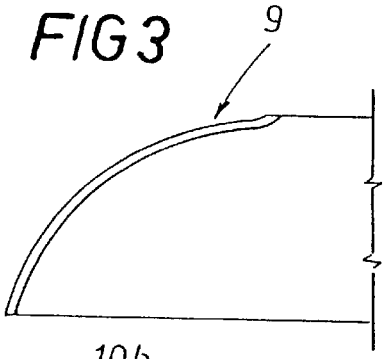

At the same time as the pinching action is applied, the tubular blank 1 is also folded double so as to draw the two envelopes 6 together, as indicated in FIGS. 2 and 2*a*. In effect, the folding operation begins at the position in which the tubular blank 1 is taken up onto the two stationary elements 7 and 9, and terminates, following a movement guided by these selfsame elements, at a position in which the blank 1 lies between the arms 15 of the gripper 4 with the two ends 10*a* and 10*b* drawn together (FIG. 3).

It is preferable that the step of folding the tubular blank 1 should be implemented simultaneously with the step of forming the pleat 12. This can be brought about by causing the third bearing element 8 and the forming element 14, drawn into mutual engagement with the tubular blank 1 between them, to move together as one toward the wheel.

The steps of the method described thus far are followed by the steps of returning the top die 13 to a level above that of the plane occupied by the tubular blanks 1 advancing along the feed direction 2, then causing the third element 8 to disengage from the bag 5 and the gripper 4 and reassume a position of readiness to engage the next tubular blank 1. One possible way of bringing about this particular step, and of implementing the method in general, is described in another application for patent of the present inventor; the disengagement can be effected simply by rendering the third element 8 capable also of translational movement parallel with the axis 20 of the wheel 3, thereby removing any obstacle to the movement of the bag 5 and the gripper 4, hence to the rotation of the wheel 3.

To the end of reducing overall cycle times when carrying the method into effect, the pinching step coincides only with the initial stage of the folding step. In effect, the simultaneous activation of these two steps is required only while there is an acceleration in the movement of the bag, given that during the subsequent deceleration it will be the selfsame forces of inertia that tend to keep the contents of the envelopes 6 in place by carrying them toward the bottom of the bag 5.

I claim:

1. A method of pleating and folding a succession of instances of an elongatedly shaped tubular blank of filter paper having two ends and containing measured and separate quantities of an infusionable substance so as to obtain from each tubular blank a filter bag having two envelopes containing the infusible substance, comprising the steps of:

conveying plurality of tubular blanks of filter paper singly and in succession along a feed direction extending substantially tangential to a rotatable wheel which is equipped with a plurality of radial grippers providing respective arms by which each filter bag is taken up, compacted and conveyed further in said feed direction;

taking up each tubular blank in succession, when that blank is in a position located above at least three bearing elements which are ordered along said feed direction, of which two are stationary, shaped in such a way as to converge toward said rotatable wheel and offered to opposite end of the respective tubular blank, while the third said bearing element is capable of movement transverse to said feed direction;

forming a pleat in an intermediate portion (10*c*) of each tubular blank in succession, using said third bearing element in succession;

folding each tubular blank in succession double in such a way as to draw two respective envelopes thereof together, by inducing a movement that commences in the position at which the respective said tubular blank is taken up and terminates at a position in which the respective said tubular blank, guided by second two stationary bearing elements, comes to rest between said arms of a respective said gripper with said two ends thereof located close together; and between said steps of forming and folding pinching said ends of each blank by action of respective movable pressure elements operating against said two stationary bearing elements so as to prevent the contents of the envelopes from escaping during the movement of the respective resulting bag toward said rotatable wheel.

2. A method as in claim 1, wherein:

said step of forming a pleat is brought about by the interaction of a suitably profiled die provided by said third bearing element, with a die of matching profile carried by an end of a forming element positioned above the respective tubular blank.

3. A method as in claim 2, wherein:

said step of folding the tubular blank double is implemented simultaneously with said step of forming the pleat as said third bearing element and said forming element are set in motion with the respective said tubular blank restrained between them.

4. A method as in claim 1 or 2, wherein:

said pinching step is implemented together with at least an initial stage of said folding step.

5. A method as in claim 1 or 2, wherein:

said pinching step is implemented simultaneously with said folding step.

* * * * *